US008985084B2

(12) United States Patent
Kuroiwa et al.

(10) Patent No.: US 8,985,084 B2
(45) Date of Patent: Mar. 24, 2015

(54) MARINE PROPULSION DEVICE

(71) Applicant: Yamaha Hatsudoki Kabushiki Kaisha, Iwata (JP)

(72) Inventors: Makoto Kuroiwa, Shizuoka (JP); Isamu Naruse, Shizuoka (JP); Satoshi Miyazaki, Shizuoka (JP); Hirokazu Kaneko, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 1 day.

(21) Appl. No.: 13/891,215

(22) Filed: May 10, 2013

(65) Prior Publication Data

US 2014/0165934 A1 Jun. 19, 2014

(30) Foreign Application Priority Data

Dec. 18, 2012 (JP) ..... 2012-275667

(51) Int. Cl.
*F02B 61/04* (2006.01)

(52) U.S. Cl.
CPC ..... *F02B 61/045* (2013.01)
USPC ..... 123/197.4; 74/603; 74/595

(58) Field of Classification Search
CPC ..... F02B 61/045
USPC ..... 123/197.4, 52.1; 74/603, 595
See application file for complete search history.

(56) References Cited

U.S. PATENT DOCUMENTS

| | | | | | |
|---|---|---|---|---|---|
| 4,043,847 | A * | 8/1977 | Just | 148/572 |
| 4,554,892 | A * | 11/1985 | Amemori et al. | 123/41.82 R |
| 5,461,940 | A * | 10/1995 | Morita | 74/603 |
| 6,648,705 | B2 * | 11/2003 | Nakata et al. | 440/83 |
| 7,263,958 | B2 * | 9/2007 | Miyazaki et al. | 123/90.31 |
| 2010/0139451 | A1 * | 6/2010 | Saito et al. | 74/595 |
| 2010/0146753 | A1 * | 6/2010 | Reeb et al. | 29/6.01 |
| 2013/0087014 | A1 * | 4/2013 | Kim et al. | 74/595 |

FOREIGN PATENT DOCUMENTS

| | | | |
|---|---|---|---|
| JP | 61217528 | A * | 9/1986 |
| JP | 62-165014 | A | 7/1987 |

* cited by examiner

*Primary Examiner* — Marguerite McMahon
(74) *Attorney, Agent, or Firm* — Keating & Bennett, LLP

(57) ABSTRACT

A crankshaft includes a coupling portion, a first functional portion, and a second functional portion. The coupling portion is coupled to a connecting rod. The first functional portion is provided on an upper portion of the crankshaft protruding from a crankcase. The first functional portion drives a first functional component. The second functional portion is provided on a lower portion of the crankshaft protruding from the crankcase. The second functional portion drives a second functional component. The entire crankshaft has been processed by a first treatment to at least enhance the corrosion resistance thereof. At least a coupling portion of the crankshaft has been processed by a second treatment to at least enhance the strength thereof. Neither of the first functional portion and the second functional portion has been processed by the second treatment.

18 Claims, 4 Drawing Sheets

MARINE PROPULSION DEVICE

CROSS-REFERENCE TO RELATED APPLICATIONS

This application claims priority to Japanese Patent Application No. 2012-275667 filed on Dec. 18, 2012, which is hereby incorporated by reference in its entirety.

BACKGROUND OF THE INVENTION

1. Field of the Invention

The present invention relates to a marine propulsion device.

2. Description of the Related Art

To reduce fuel consumption, marine propulsion devices such as outboard motors have been demanded to achieve high compression within the combustion chambers of an engine. However, a load acting on a crankshaft is increased due to such high compression.

In Japan Laid-open Patent Application Publication No. JP-A-S62-165014, axial support portions (journals) of a crankshaft, which are required to be durable, are made of a material with a durability higher than that of the other portions. The axial support portions are connected to the other portions by welding. JP-A-S62-165014 discloses that the fatigue strength of the crankshaft is enhanced due to the above-described structure. JP-A-S62-165014 also discloses that the manufacturing cost can be kept low compared to a case in which the crankshaft is entirely made of a highly durable material.

However, in such a crankshaft as described in JP-S62-165014, a plurality of components are required to be welded to each other after being manufactured. In this case, the number of manufacturing steps is increased. Therefore, the manufacturing cost cannot be necessarily kept low.

On the other hand, the strength of a crankshaft can be enhanced by enlarging its size and shape without changing its material. However, enlarging the size and shape of a crankshaft results in an increase in the weight of the crankshaft. This goes against the original objective, that is, to reduce fuel consumption. Further, in an outboard motor, for instance, an engine is disposed within an engine cover. Therefore, the engine size is constrained by the size of the engine cover. In some cases, a plurality of outboard motors are mounted in alignment on a vessel body. Under this condition, it is difficult to enlarge the engine cover and still reliably produce adequate steering ranges for adjacent outboard motors. Thus, it is also not easy to enlarge the engine itself. In view of this, it is also difficult to enlarge the size and shape of the crankshaft.

Moreover, the strength of a crankshaft can be also enhanced by executing a high strengthening treatment on the entire crankshaft. However, a soft nitriding treatment is conventionally performed on normal crankshafts of marine propulsion devices. The soft nitriding treatment is a treatment intended to mainly enhance corrosion resistance and abrasion resistance. The soft nitriding treatment also includes an advantageous effect of enhancing the strength. Therefore, a sufficient strength can be achieved for crankshafts of current marine propulsion devices only with the soft nitriding treatment.

However, it is insufficient to perform only the soft nitriding treatment to obtain a strength required for a crankshaft in which high compression is achieved within the combustion chambers. In view of this, it is possible to perform a high strengthening treatment such as induction hardening with respect to the entire crankshaft in addition to a gas soft nitriding treatment. In this case, however, the crankshaft is greatly affected and thermally expanded by the induction hardening treatment. Therefore, after the thermal treatment, a polishing treatment is required to be performed on those portions requiring accurate dimensions. Thus, the number of manufacturing steps is inevitably increased as a whole.

Further, a functional portion is disposed on an end of a crankshaft of a marine propulsion device in order to transmit power to another functional component different from the crankshaft. For example, the functional portion is a spline or a gear to couple the crankshaft to a drive shaft. Alternatively, the functional portion is, for instance, a gear to drive a cam belt or a timing belt. When an induction hardening treatment is performed on the entire crankshaft including the functional portion, thermal expansion is caused due to the induction hardening treatment. Thermal expansion produces a drawback in that the accuracy in the axial center of the functional portion is degraded and the function of the functional portion is deteriorated.

Furthermore, when a polishing treatment is performed after an induction hardening treatment in order to enhance the accuracy in the axial center, a nitride layer is inevitably eliminated through the polishing treatment because the nitride layer has quite a small thickness. In the crankshaft, the functional portion (e.g., a spline, a gear, etc.) is not necessarily positioned in an area filled with a lubricating oil. Especially in an engine of a marine propulsion device, chances are that such a functional portion is exposed to an atmosphere including seawater. When the nitride layer is eliminated through the polishing treatment, a drawback is produced in that the functional portion loses a corrosive-resistant function. Therefore, in terms of corrosion resistance, deterioration in the function of the functional portion is also inevitably caused by executing the induction hardening treatment on the entire crankshaft.

It should be noted that not only in executing an induction hardening treatment but also in executing a high strengthening treatment such as a rolling treatment, a polishing treatment is required because deformation results from the induction hardening treatment or the high strengthening treatment. Therefore, a drawback is produced similarly to the above.

SUMMARY OF THE INVENTION

Preferred embodiments of the present invention achieve a reduction in the size of a crankshaft and enhance the reliability and functioning of the crankshaft in a marine propulsion device.

A marine propulsion device according to a first preferred embodiment of the present invention includes an engine cover, an engine, a drive shaft, and a propeller shaft. The engine is disposed within the engine cover. The drive shaft is disposed below the engine and along a vertical plane. The propeller shaft is connected to the drive shaft in a power transmittable state. The engine includes a cylinder, a piston, a connecting rod, a crankshaft, and a crankcase. The piston is disposed inside the cylinder and is configured to slide therein. The connecting rod is coupled to the piston and is configured to convert a reciprocating motion of the piston into a rotary motion. The crankshaft is coupled to the connecting rod and the drive shaft in a power transmittable state. An upper portion of the crankshaft and a lower portion of the crankshaft protrude outwardly from the crankcase. The crankshaft preferably includes a coupling portion, a first functional portion, and a second functional portion. The coupling portion is coupled to the connecting rod. The first functional portion is provided on the upper portion of the crankshaft protruding from the crankcase. The first functional portion has been processed by machining to drive a first functional component. The second functional portion is provided on the lower portion of the crankshaft protruding from the crankcase. The second functional portion has been processed by machining to drive a second functional component. The entire crankshaft has been processed by a first treatment to at least enhance a corrosion resistance thereof. At least the coupling portion of the crankshaft has been processed by a second treatment to at least enhance a strength thereof. Preferably, neither of the first functional portion and the second functional portion have been processed by the second treatment.

In the marine propulsion device according to the first preferred embodiment, the entire crankshaft has been processed by the first treatment to at least enhance the corrosion resistance thereof. Therefore, an increase in the size of the crankshaft is prevented, while the strength thereof is enhanced. Further, at least the coupling portion of the crankshaft has been processed by the second treatment to at least enhance the strength thereof. Therefore, it is possible for the coupling portion to obtain a strength so as to endure a load attributed to the high compression within the combustion chambers of the engine. Yet further, the coupling portion is disposed within the crankcase, and is thus isolated from an atmosphere including seawater. Therefore, a corrosion-related problem attributed to seawater is not caused even when the coupling portion is polished or the like after the second treatment in order to obtain a desired accuracy. Furthermore, neither of the first functional portion and the second functional portion, which could be exposed to an atmosphere including seawater, have been processed by the second treatment. Therefore, neither of the first functional portion and the second functional portion is required to be polished or the like after the first treatment. Accordingly, it is possible to enhance the reliabilities and functionalities of the first functional portion and the second functional portion.

A marine propulsion device according to a second preferred embodiment includes an engine cover, an engine, a drive shaft, and a propeller shaft. The engine is disposed within the engine cover. The drive shaft is disposed below the engine and along a vertical plane. The propeller shaft is connected to the drive shaft in a power transmittable state. The engine includes a plurality of cylinders, a plurality of pistons, a plurality of connecting rods, a crankshaft, and a crankcase. The plurality of pistons are disposed inside the plurality of cylinders on a one-to-one basis, and are configured to slide therein. The plurality of connecting rods are coupled to the plurality of pistons on a one-to-one basis, and are configured to convert reciprocating motions of the pistons into a rotary motion. The crankshaft is coupled to the plurality of connecting rods and to the drive shaft in a power transmittable state. An upper portion of the crankshaft and a lower portion of the crankshaft protrude outwardly from the crankcase. The crankshaft preferably includes a plurality of coupling portions, a first functional portion, and a second functional portion. The plurality of coupling portions are coupled to the plurality of connecting rods on a one-to-one basis. The first functional portion is provided on the upper portion of the crankshaft protruding from the crankcase. The first functional portion has been processed by machining to drive a first functional component. The second functional portion is provided on the lower portion of the crankshaft protruding from the crankcase. The second functional portion has been processed by machining to drive a second functional component. The entire crankshaft has been processed by a first treatment to at least enhance a corrosion resistance thereof. At least the plurality of coupling portions of the crankshaft have been processed by a second treatment to at least enhance a strength thereof. Neither of the first functional portion and the second functional portion have been processed by the second treatment.

In the marine propulsion device according to the second preferred embodiment, the entire crankshaft has been processed by the first treatment to at least enhance the corrosion resistance thereof. Therefore, an increase in the size of the crankshaft is prevented, while the strength thereof is enhanced. Further, at least the plurality of coupling portions of the crankshaft have been processed by the second treatment to at least enhance the strength thereof. Therefore, it is possible for the plurality of coupling portions to obtain a strength so as to endure a load attributed to high compression within the combustion chambers of the engine. Yet further, the plurality of coupling portions are disposed within the crankcase, and are thus isolated from an atmosphere including seawater. Therefore, a corrosion-related problem attributed to seawater is not caused even when the plurality of coupling portions are polished or the like after the second treatment in order to obtain a desired accuracy. Furthermore, neither of the first functional portion and the second functional portion, which could be exposed to an atmosphere including seawater, has been processed by the second treatment. Therefore, neither of the first functional portion and the second functional portion is required to be polished or the like after the first treatment. Accordingly, it is possible to enhance the reliabilities and functionalities of the first functional portion and the second functional portion.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
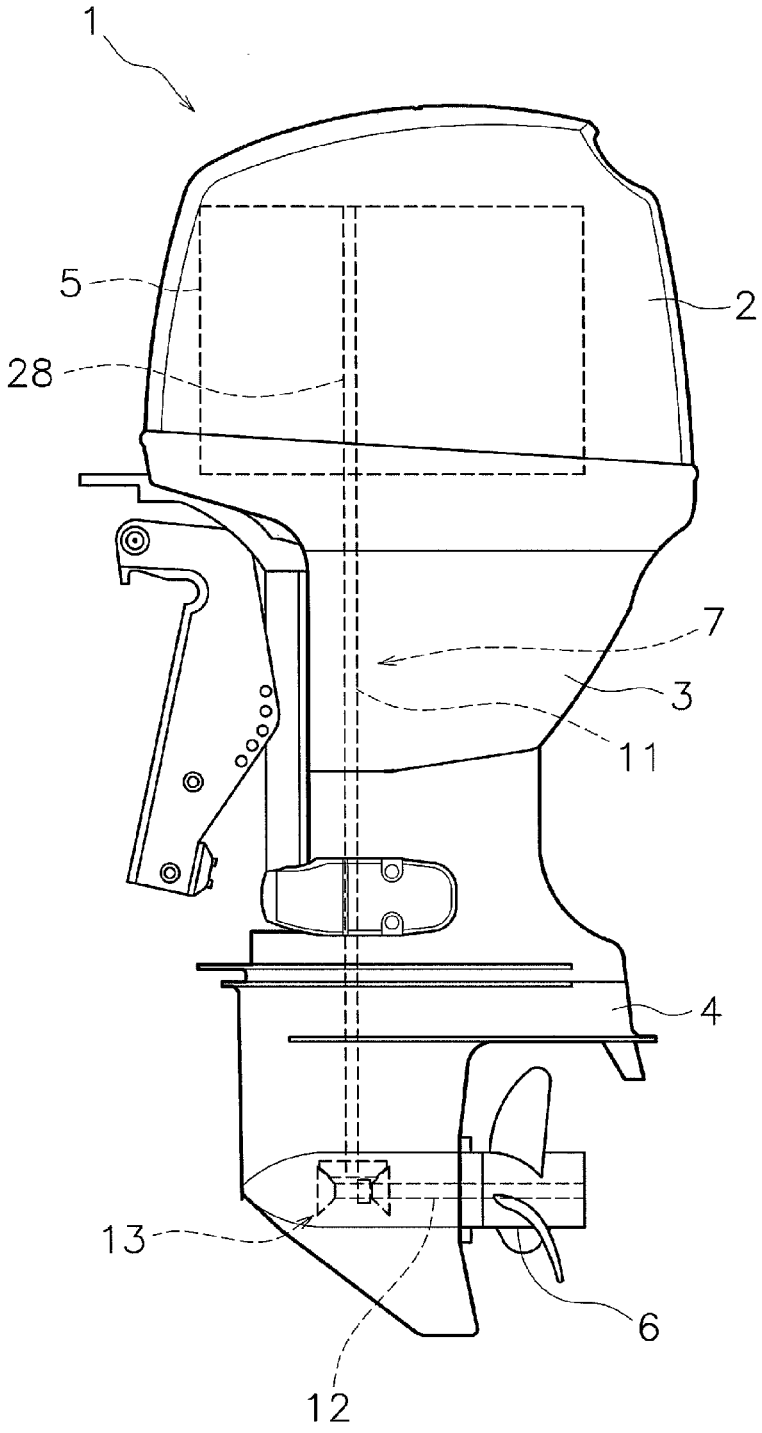
FIG. 1 is a side view of a marine propulsion device.

Explanation will be hereinafter provided for a marine propulsion device 1 according to exemplary preferred embodiments of the present invention with reference to the attached drawings. FIG. 1 is a side view of the marine propulsion device 1. The marine propulsion device 1 includes an engine cover 2, an upper casing 3, and a lower casing 4. The upper casing 3 is disposed below the engine cover 2. The lower casing 4 is disposed below the upper casing 3. The marine propulsion device 1 includes an engine 5, a propeller 6, and a power transmission mechanism 7. The engine 5 is disposed in the upper portion of the marine propulsion device 1. The engine 5 is disposed within the engine cover 2. The propeller 6 is disposed in the lower portion of the marine propulsion device 1. The propeller 6 is attached to the lower casing 4. The propeller 6 is configured to be driven and rotated by a driving force of the engine 5.

The power transmission mechanism 7 is configured to transmit the driving force from the engine 5 to the propeller 6. The power transmission mechanism 7 preferably includes a drive shaft 11, a propeller shaft 12, and a shift mechanism 13. The drive shaft 11 is disposed below the engine 5 along a vertical plane. The drive shaft 11 is configured to transmit the power from the engine 5. The propeller shaft 12 is disposed along a back-and-forth direction. The propeller shaft 12 is connected to the drive shaft 11 in a power transmittable state. The propeller shaft 12 is coupled to the lower portion of the drive shaft 11 through the shift mechanism 13. The propeller shaft 12 is configured to transmit the driving force from the drive shaft 11 to the propeller 6. The shift mechanism 13 is configured to switch the rotational direction of the power transmitted from the drive shaft 11 to the propeller shaft 12. The shift mechanism 13 is configured to switch the rotational direction of the propeller 6 between a direction of forwardly moving a vessel on which the marine propulsion device 1 is mounted and a direction of backwardly moving the vessel.

Figure 2:
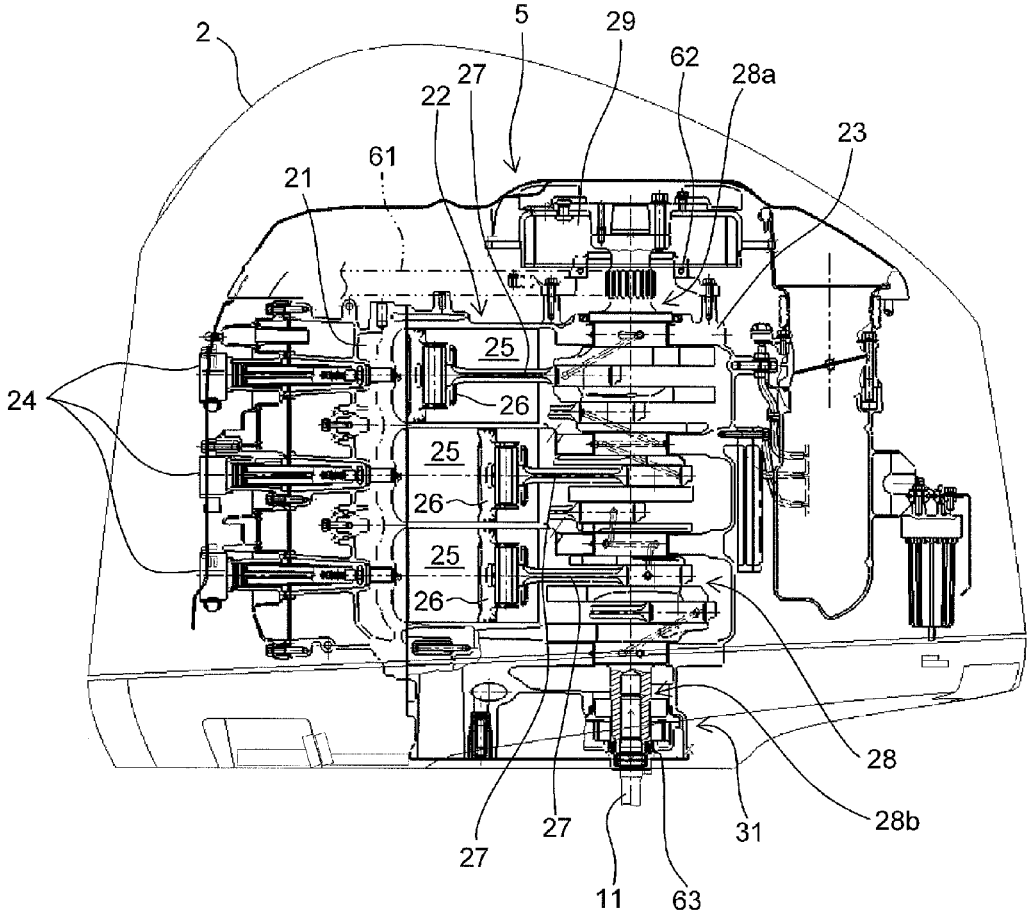
FIG. 2 is a cross-sectional view of an engine cover and an engine.

FIG. 2 is a cross-sectional view of the engine cover 2 and the engine 5. The engine 5 includes a cylinder head 21, a cylinder body 22, and a crankcase 23. A plurality of ignition devices 24 are attached to the cylinder head 21. The cylinder body 22 includes a plurality of cylinders 25. It should be noted that in the present exemplary preferred embodiment, the cylinder body 22 preferably includes six cylinders 25, for example, but FIG. 2 illustrates only three of the cylinders 25. The three cylinders 25 illustrated in FIG. 2 are disposed in alignment along the vertical direction. The remaining three of the cylinders 25 (not illustrated in the figures) are disposed leftwards (i.e., on the front side of the sheet of FIG. 2) or rightwards (i.e., on the rear side of the sheet of FIG. 2) of the three cylinders 25 illustrated in FIG. 2.

The engine 5 includes a plurality of pistons 26, a plurality of connecting rods 27, and a crankshaft 28. Each of the plurality of pistons 26 is configured to slide inside a corresponding one of the plurality of cylinders 25. The plurality of connecting rods 27 are connected to the plurality of pistons 26 on a one-to-one basis. Each connecting rod 27 is configured to convert the reciprocating motion of each piston 26 into a rotary motion.

The crankshaft 28 is connected to the plurality of connecting rods 27. Similarly to the drive shaft 11, the crankshaft 28 is disposed along a vertical plane.

The crankcase 23 accommodates a portion of the crankshaft 28. An upper portion 28*a* of the crankshaft 28 protrudes to the outside of the crankcase 23. A lower portion 28*b* of the crankshaft 28 protrudes to the outside of the crankcase 23. The crankcase 23 supports the crankshaft 28. The inner space of the crankcase 23 is filled with a lubricating oil.

A flywheel magnet 29 is preferably disposed above the crankcase 23. The upper portion 28*a* of the crankshaft 28 is attached to the flywheel magnet 29. An oil pump 31 and the drive shaft 11 are disposed below the crankcase 23. The lower portion 28*b* of the crankshaft 28 is preferably disposed inside the oil pump 31. The crankshaft 28 is connected to the drive shaft 11 in a power transmittable state. Specifically, the crankshaft 28 is disposed coaxially with the drive shaft 11. The lower end portion of the crankshaft 28 is joined to the upper end portion of the drive shaft 11.

Figure 3:
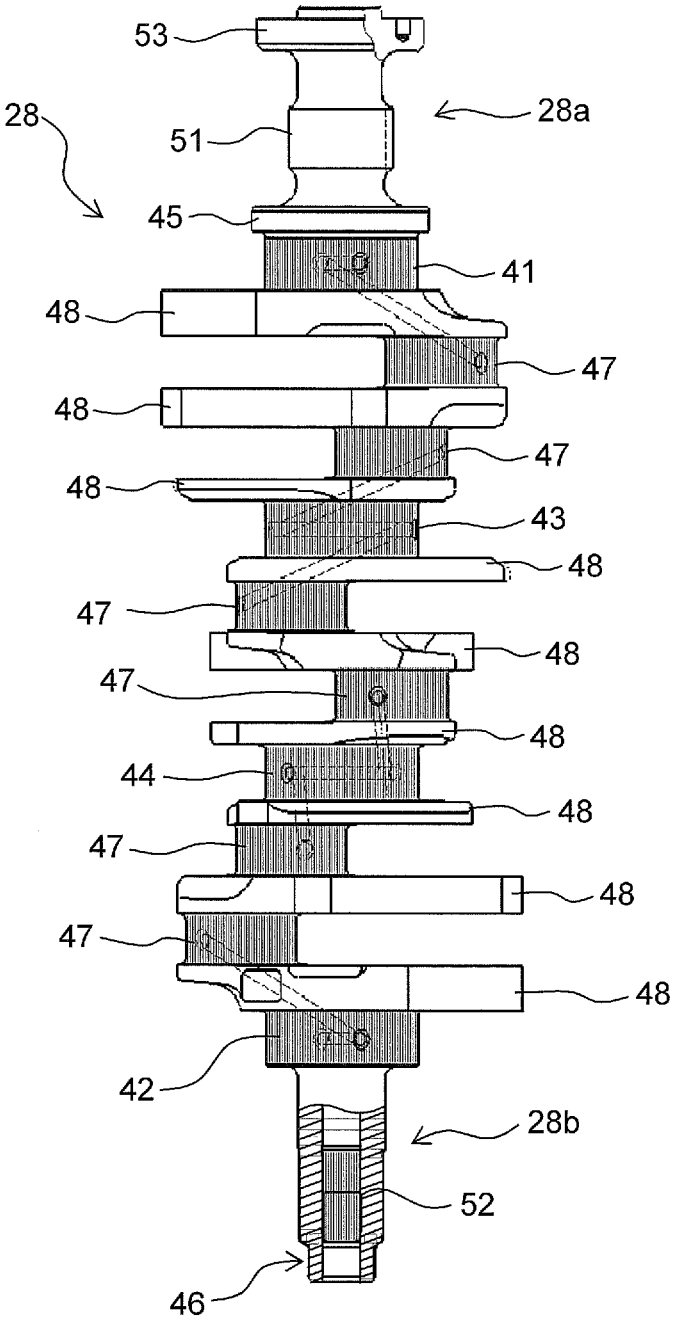
FIG. 3 is a side view of a crankshaft.

FIG. 3 is a side view of the crankshaft 28. The crankshaft 28 is preferably made of an iron-based material. For example, the crankshaft 28 can be made of machine structural use carbon steel (S45C, S50C, etc.) or alloy steel (chrome molybdenum steel, etc.). As illustrated in FIG. 3, the crankshaft 28 includes a plurality of holding portions 41 to 44, a plurality of coupling portions 47, and a plurality of crank arms 48. The plurality of holding portions 41 to 44, the plurality of coupling portions 47, and the plurality of crank arms 48 are disposed in the inner space of the crankcase 23.

The plurality of holding portions 41 to 44 are so-called crank journals, and are held by the crankcase 23. The plurality of holding portions 41 to 44 include a first holding portion 41, a second holding portion 42, and intermediate holding portions 43 and 44. The first holding portion 41 is held by the crankcase 23 and is disposed above the plurality of coupling portions 47. The second holding portion 42 is held by the crankcase 23 and is disposed below the plurality of coupling portions 47. The intermediate holding portions 43 and 44 are positioned between the first holding portion 41 and the second holding portion 42. The plurality of coupling portions 47 are so-called crankpins, and are coupled to the plurality of connecting rods 27 on a one-to-one basis.

The crankshaft 28 includes an upper seal receiving portion 45 and a lower seal receiving portion 46. The upper seal receiving portion 45 is supported by the crankcase 23 through a seal member 62 illustrated in FIG. 2. The lower seal receiving portion 46 is supported by a case of the oil pump 31 through a seal member 63 illustrated in FIG. 2. The plurality of holding portions 41 to 44, plurality of coupling portions 47, and plurality of crank arms 48 are positioned between the upper seal receiving portion 45 and the lower seal receiving portion 46. Further, the first holding portion 41 and the second holding portion 42 are also positioned between the upper seal receiving portion 45 and the lower seal receiving portion 46.

The crankshaft 28 includes a first functional portion 51. The first functional portion 51 is disposed on the upper portion 28*a* of the crankshaft 28 protruding from the crankcase 23. The first functional portion 51 has been processed by machining to drive a first functional component. As illustrated in FIG. 2, the engine 5 includes a cam belt 61. In the present exemplary preferred embodiment, the first functional component is the cam belt 61. The first functional portion 51 is configured to transmit the rotation of the crankshaft 28 to the cam belt 61 while being engaged with the cam belt 61. In order to drive the cam belt 61, a drive gear is provided on the first functional portion 51 by machining.

The crankshaft 28 includes an upper attachment portion 53. The upper attachment portion 53 is disposed on the upper portion 28*a* of the crankshaft 28 protruding from the crankcase 23. The flywheel magnet 29 is attached to the upper attachment portion 53.

The crankshaft 28 includes a second functional portion 52. The second functional portion 52 is disposed on the lower portion 28*b* of the crankshaft 28 protruding from the crankcase 23. The second functional portion 52 has been processed by machining to drive a second functional component. In the present exemplary preferred embodiment, the second functional component includes the drive shaft 11. The lower portion 28*b* of the crankshaft 28 is coupled to the drive shaft 11. A spline is provided on the second functional portion 52 by machining in order to couple the crankshaft 28 to the drive shaft 11.

The entire crankshaft 28 has been processed by a first treatment to at least enhance the corrosion resistance thereof. The first treatment is preferably a soft nitriding treatment. In the soft nitriding treatment, nitrogen is diffused and permeated into a surface layer of the crankshaft 28. Accordingly, the nitrogen amount is increased in the surface layer, and thereby, a compound layer made of nitride is formed. Gas soft nitriding, ion soft nitriding, toughtride, sulfnitriding and so forth can be exemplified as the soft nitriding treatment.

The plurality of coupling portions 47 of the crankshaft 28 have been processed by a second treatment to at least enhance the strength thereof. Further, the plurality of holding portions 41 to 44 have also been processed by the second treatment. The second treatment is preferably an induction hardening treatment. It should be noted neither of the first functional portion 51 and the second functional portion 52 has been processed by the second treatment. Further, the upper attachment portion 53 also has not been processed by the second treatment.

Figure 4:
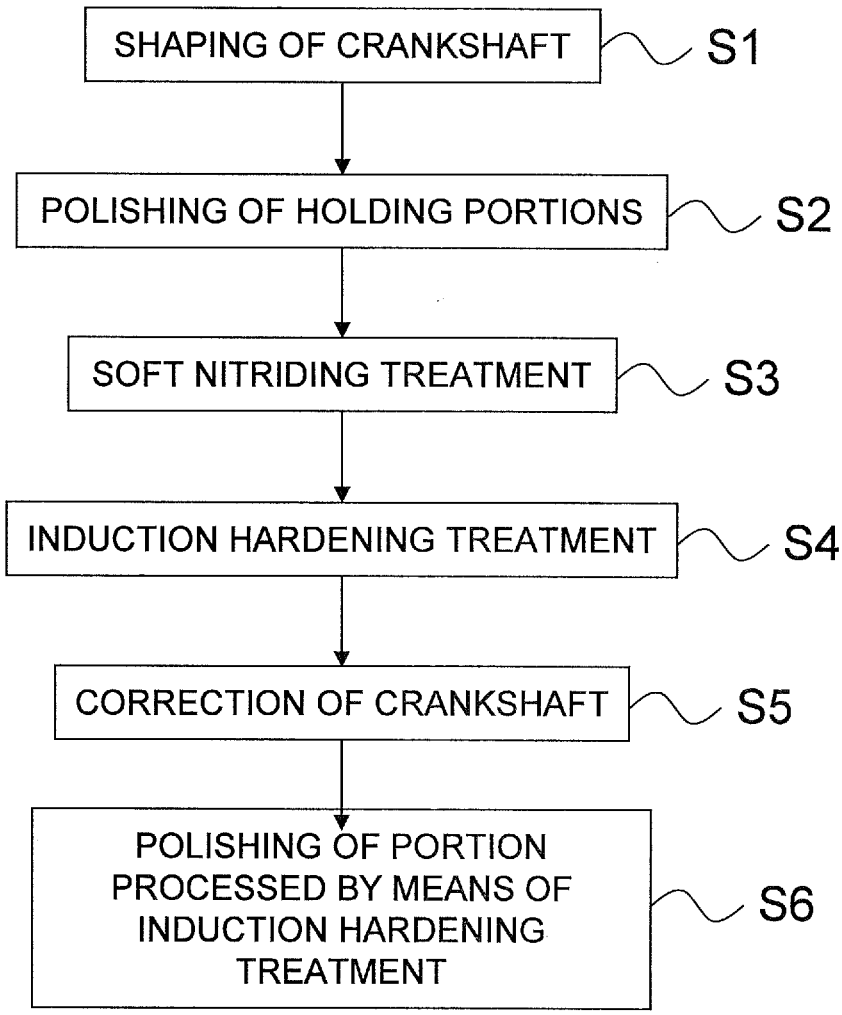
FIG. 4 is a flowchart representing a method of manufacturing the crankshaft.

Next, explanation will be provided for a preferred method of manufacturing the crankshaft 28. FIG. 4 is a flowchart representing a preferred procedure of manufacturing the crankshaft 28. As shown in FIG. 4, shaping of the crankshaft is executed in Step S1. A blank is provided in a predetermined shape of the crankshaft 28 by turning with a lathe, for example. It should be noted that any processing method other than turning with a lathe can be used. Next, polishing of the plurality of holding portions 41 to 44 is executed in Step S2. The holding portions 41 to 44 are polished such that the accuracy in the shape thereof falls within a desired range.

Next, a soft nitriding treatment is executed in Step S3. The entire crankshaft 28 is preferably processed by the soft nitriding treatment. Next, an induction hardening treatment is executed in Step S4. The plurality of coupling portions 47 and the plurality of holding portions 41 to 44 haven been processed by the induction hardening treatment. It should be noted that other portions except for the plurality of coupling portions 47 and the plurality of holding portions 41 to 44 are not processed by the induction hardening treatment.

Next, correction of the crankshaft is executed in Step S5. The crankshaft 28 is corrected such that the accuracy in the shape thereof falls within a desired range. Polishing is executed for the portion processed by the induction hardening treatment. Polishing is executed such that the accuracy in the shape of the portion processed by the induction hardening treatment in Step S4 falls within a desired range. In other words, the plurality of coupling portions 47 and the plurality of holding portions 41 to 44 are polished.

In the marine propulsion device 1 according to the present exemplary preferred embodiment, the entire crankshaft 28 is processed by the first treatment to at least enhance the corrosion resistance thereof. Therefore, an increase in the size of the crankshaft 28 is prevented, while the strength thereof is enhanced. Moreover, the plurality of coupling portions 47 of the crankshaft 28 have been processed by the second treatment to at least enhance the strength thereof. Therefore, it is possible for the plurality of coupling portions 47 to obtain the strength as to endure a load attributed to high compression within the combustion chambers of the engine 5. Further, the plurality of holding portions 41 to 44 are also processed by the second treatment. Therefore, it is also possible for the plurality of holding portions 41 to 44 to obtain the desired strength.

Further, the plurality of coupling portions 47 are disposed within the crankcase 23, and are thus isolated from an atmosphere including seawater. Therefore, a corrosion-related problem attributed to seawater is not caused even when the protective layers, provided on the surfaces of the coupling portions 47 by the first treatment, are removed therefrom by polishing. Similarly, a corrosion-related problem is not caused even when the protective layers, provided on the plurality of holding portions 41 to 44, are removed by polishing.

Yet further, neither of the first functional portion 51 and the second functional portion 52, which could be exposed to an atmosphere including seawater, is processed by the second treatment. Therefore, such a processing as polishing is not required for the first functional portion 51 and the second functional portion 52 after the first treatment. Thus, the first functional portion 51 and the second functional portion 52 are not actually processed by polishing, and the protective layers provided thereon by the first treatment are maintained. Similarly, the upper attachment portion 53 is not processed by polishing, and the protective layer provided thereon by the first treatment is maintained. Consequently, it is possible to enhance the reliabilities and functionalities of the first functional portion 51, the second functional portion 52, and the upper attachment portion 53.

Exemplary preferred embodiments of the present invention have been disclosed above. However, the present invention is not limited to the above-described exemplary preferred embodiments, and a variety of changes can be made without departing from the scope of the present invention.

The number of cylinders of the engine 5 is not limited to six. In the above-described exemplary preferred embodiments, the engine 5 preferably is a multi-cylinder type, but alternatively, may be a single-cylinder type. In this case, the number of the coupling portions 47 of the crankshaft 28 preferably is one.

The first treatment is not limited to the soft nitriding treatment, and may be any other treatment to at least enhance the corrosion resistance. The second treatment is not limited to the induction hardening treatment, and may be any other treatment to at least enhance the strength. For example, the second treatment may be rolling.

Either a portion or all of the plurality of holding portions 41 to 44 may not be processed by the second treatment. Alternatively, the other portions except for the plurality of coupling portions 47 and the plurality of holding portions 41 to 44 may be processed by the second treatment. It should be noted that the other portions, except for the upper portion 28*a* and the lower portion 28*b* of the crankshaft 28 protruding from the crankcase 23, are preferably not processed by the second treatment.

In the above-described exemplary preferred embodiments, the crankshaft 28 is directly connected to the drive shaft 11. However, rotation of the crankshaft 28 may be configured to be transmitted to the drive shaft 11 through a drive gear. In this case, the drive gear may be provided on the second functional portion 52 by machining in order to drive the drive shaft 11.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion device comprising:

an engine cover;

an engine disposed within the engine cover;

a drive shaft disposed below the engine and along a vertical plane; and a propeller shaft connected to the drive shaft in a power transmittable state; wherein the engine includes:

a cylinder;

a piston configured to slide inside the cylinder;

a connecting rod coupled to the piston, the connecting rod configured to convert a reciprocating motion of the piston into a rotary motion;

a crankshaft coupled to the connecting rod, the crankshaft connected to the drive shaft in a power transmittable state; and a crankcase accommodating a portion of the crankshaft, an upper portion of the crankshaft and a lower portion of the crankshaft protruding outwardly from the crankcase;

the crankshaft includes:

a coupling portion coupled to the connecting rod;

a first functional portion provided on the upper portion of the crankshaft protruding from the crankcase, the first functional portion arranged to drive a first functional component; and a second functional portion provided on the lower portion of the crankshaft protruding from the crankcase, the second functional portion arranged to drive a second functional component;

the entire crankshaft has been processed by a first treatment to at least enhance a corrosion resistance thereof;

at least an entire surface of the coupling portion of the crankshaft has been processed by a second treatment to at least enhance a strength thereof; and neither of the first functional portion and the second functional portion has been processed by the second treatment.

2. The marine propulsion device according to claim 1, wherein the crankshaft includes:

a first holding portion disposed above the coupling portion and held by the crankcase; and a second holding portion disposed below the coupling portion and held by the crankcase; wherein the first holding portion and the second holding portion have been processed by the second treatment.

3. The marine propulsion device according to claim 1, wherein the first functional component is a cam belt, and the first functional portion includes a drive gear that drives the cam belt.

4. The marine propulsion device according to claim 1, wherein the second functional component includes the drive shaft, and the second functional portion includes a spline that couples the lower portion of the crankshaft to the portion of the driving shaft.

5. The marine propulsion device according to claim 1, wherein the second functional component includes the drive shaft, and the second functional portion includes a drive gear that drives the drive shaft.

6. The marine propulsion device according to claim 1, wherein the first treatment is a soft nitriding treatment.

7. The marine propulsion device according to claim 1, wherein the second treatment is either an induction hardening treatment or a rolling treatment.

8. A marine propulsion device comprising:

an engine cover;

an engine disposed within the engine cover;

a drive shaft disposed below the engine and along a vertical plane; and a propeller shaft connected to the drive shaft in a power transmittable state;

wherein the engine includes:

a plurality of cylinders:

a plurality of pistons configured to slide inside the plurality of cylinders on a one-to-one basis;

a plurality of connecting rods coupled to the plurality of pistons on a one-to-one basis, the plurality of connecting rods configured to convert reciprocating motions of the pistons into a rotary motion;

a crankshaft coupled to the plurality of connecting rods, the crankshaft connected to the drive shaft in a power transmittable state; and a crankcase accommodating a portion of the crankshaft, an upper portion of the crankshaft and a lower portion of the crankshaft protruding outwardly from the crankcase;

the crankshaft includes:

a plurality of coupling portions coupled to the plurality of connecting rods on a one-to-one basis;

a first functional portion provided on the upper portion of the crankshaft protruding from the crankcase, the first functional portion arranged to drive a first functional component; and a second functional portion provided on the lower portion of the crankshaft protruding from the crankcase, the second functional portion arranged to drive a second functional component;

the entire crankshaft has been processed by a first treatment to at least enhance a corrosion resistance thereof;

at least an entire surface of the plurality of coupling portions of the crankshaft have been processed by a second treatment to at least enhance a strength thereof; and neither of the first functional portion and the second functional portion has been processed by the second treatment.

9. The marine propulsion device according to claim 8, wherein the crankshaft includes:

a first holding portion disposed above the plurality of coupling portions and held by the crankcase; and a second holding portion disposed below the plurality of coupling portions and held by the crankcase; wherein the first holding portion and the second holding portion have been processed by the second treatment.

10. The marine propulsion device according to claim 8, wherein the first functional component is a cam belt, and the first functional portion includes a drive gear that drives the cam belt.

11. The marine propulsion device according to claim 8, wherein the second functional component includes the drive shaft, and the second functional portion includes a spline that couples the lower portion of the crankshaft to the drive shaft.

12. The marine propulsion device according to claim 8, wherein the second functional component includes the drive shaft, and the second functional portion includes a drive gear that drives the drive shaft.

13. The marine propulsion device according to claim 8, wherein the first treatment is a soft nitriding treatment.

14. The marine propulsion device according to claim 8, wherein the second treatment is either an induction hardening treatment or a rolling treatment.

15. A method of manufacturing a crankshaft in a marine propulsion device, the method comprising the steps of:

shaping a crankshaft to include a coupling portion configured to be coupled to a connecting rod, a first functional portion provided on an upper portion of the crankshaft and configured to drive a first functional component, and a second functional portion provided on a lower portion of the crankshaft and configured to drive a second functional component;

processing the entire crankshaft by a first treatment to at least enhance a corrosion resistance thereof; and processing at least an entire surface of the coupling portion of the crankshaft by a second treatment to at least enhance a strength thereof; wherein the first functional portion and the second functional portion are not processed by the second treatment.

16. The method of manufacturing a crankshaft according to claim 15, further comprising the steps of:

providing the crankshaft with a first holding portion disposed above the coupling portion and configured to be held by a crankcase;

providing the crankshaft with a second holding portion disposed below the coupling portion and configured to be held by the crankcase; and processing the first holding portion and the second holding portion by the second treatment.

17. The method of manufacturing a crankshaft according to claim 15, wherein the first treatment is a soft nitriding treatment.

18. The method of manufacturing a crankshaft according to claim 15, wherein the second treatment is one of an induction hardening treatment and a rolling treatment.

* * * * *